US006188859B1

(12) United States Patent
Wang et al.

(10) Patent No.: US 6,188,859 B1
(45) Date of Patent: Feb. 13, 2001

(54) STRUCTURE OF DEVELOPER REPLENISHING CONTAINER

(75) Inventors: Jui-Chi Wang; Robin Hsu; Ya-Li Huang; Kuan-Tung Li, all of Taichung (TW)

(73) Assignee: General Plastic Industrial Co., Taichung (TW)

( * ) Notice: Under 35 U.S.C. 154(b), the term of this patent shall be extended for 0 days.

(21) Appl. No.: 09/527,881

(22) Filed: Mar. 20, 2000

Related U.S. Application Data

(63) Continuation-in-part of application No. 09/283,324, filed on Mar. 31, 1999, now abandoned.

(51) Int. Cl.[7] ..... G03G 15/08
(52) U.S. Cl. ..... 399/262; 222/DIG. 1
(58) Field of Search ..... 399/260, 262; 222/DIG. 1; 215/49, 42

(56) References Cited

U.S. PATENT DOCUMENTS 3,721,360 * 3/1973 Collie ..... 215/49
4,060,105 * 11/1977 Feldeisen ..... 222/DIG. 1 X
5,557,381 * 9/1996 Sakamoto et al. ..... 399/262 X
5,627,631 * 5/1997 Ichikawa et al. ..... 222/DIG. 1
5,774,772 * 6/1998 Kai et al. ..... 399/260
5,794,108 * 8/1998 Yoshizawa et al. ..... 399/262
5,867,757 * 2/1999 Okazaki et al. ..... 399/262
5,908,124 * 6/1999 Klauke et al. ..... 215/42 X
5,909,610 * 6/1999 Yoshiki et al. ..... 399/262
6,038,422 * 3/2000 Loewel ..... 399/262
6,067,432 * 5/2000 Huang ..... 399/262

FOREIGN PATENT DOCUMENTS 63-94267 * 4/1988 (JP) .
4-477 * 1/1992 (JP) .

* cited by examiner

*Primary Examiner*—Susan S. Y. Lee
(74) *Attorney, Agent, or Firm*—Pro-Tchtor International Services

(57) ABSTRACT

A developer replenishing container having a developer guide cone connected between a cylindrical body portion and a bottle neck for guiding developer out of the cylindrical body portion via the bottle neck, wherein the developer guide cone defines a spiral guide wall portion and a spiral developer flow passageway for guiding developer from the cylindrical body portion toward the bottle neck, the developer guide cone having a diameter made gradually reduced toward the bottle neck, and an angle of slope within about 15°~45°, the spiral guide wall portion having a depth within about 3~18 mm, the spiral developer flow passageway having a rear end smoothly extended to the bottle neck in a flush manner for guiding developer to the bottle neck.

3 Claims, 4 Drawing Sheets

STRUCTURE OF DEVELOPER REPLENISHING CONTAINER

CROSS-REFERENCE TO RELATED APPLICATION

The present invention is a continuation-in-part of U.S. patent application Ser. No. 09/283,324 filed on Mar. 31, 1999, entitled "Developer Replenishing Container", now abandoned.

Various developer replenishing container means for electrophotographic image forming apparatus have been disclosed. Examples are seen in U.S. Pat. Nos. 5,455,622; 5,500,719. These developer replenishing container means commonly comprise container body having a spiral guide rib around the inside wall and an opening at one end, and ratchet means at the opening through which the container body can be rotated by a driving mechanism inside the electrophotographic image forming apparatus. This design of developer replenishing container means in functional, however developer tends to be accumulated in gaps in the ratchet means.

SUMMARY OF THE INVENTION

The present invention has been accomplished to provide a developer replenishing container, which eliminates the aforesaid problem. According to the present invention, the developer replenishing container comprises a cylindrical body portion, a bottleneck, and a developer guide cone connected between the cylindrical body portion and the bottleneck to guide developer out of the cylindrical body portion via the bottleneck. The developer guide cone comprises a spiral guide wall portion defining a spiral developer flow passageway for guiding developer from the cylindrical body portion toward the bottleneck. The developer guide cone has a diameter made gradually reduced toward the bottleneck, and an angle of slope within about 15°~45°. The spiral guide wall portion has a depth within about 3~18 mm. The spiral developer flow passageway has a rear end smoothly extended to the bottleneck in a flush manner for guiding developer to the bottleneck.

DETAILED DESCRIPTION OF THE PREFERRED EMBODIMENT

Figure 1:
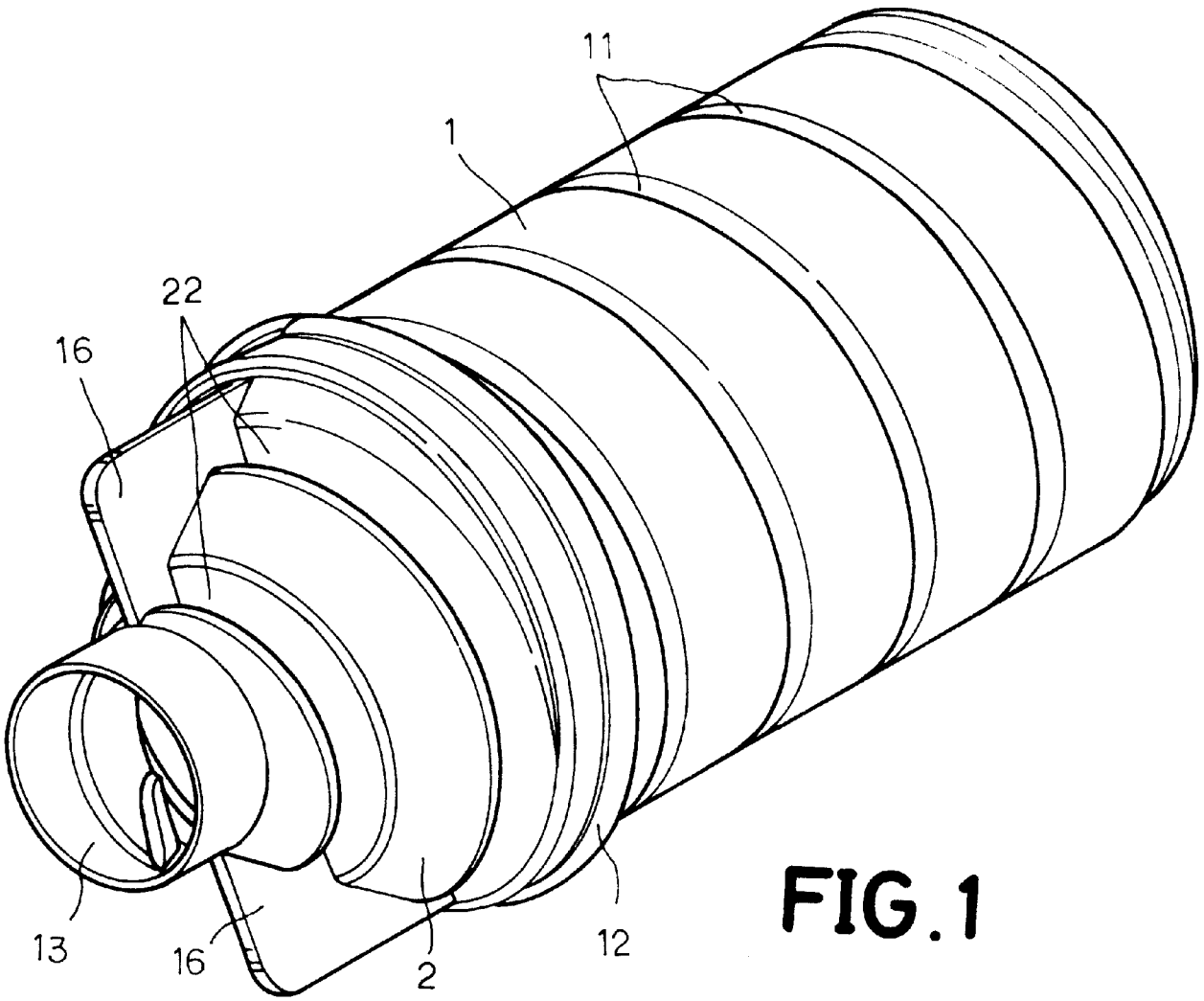
FIG. 1 is a perspective view of a developer replenishing container according to the present invention.
Figure 2:
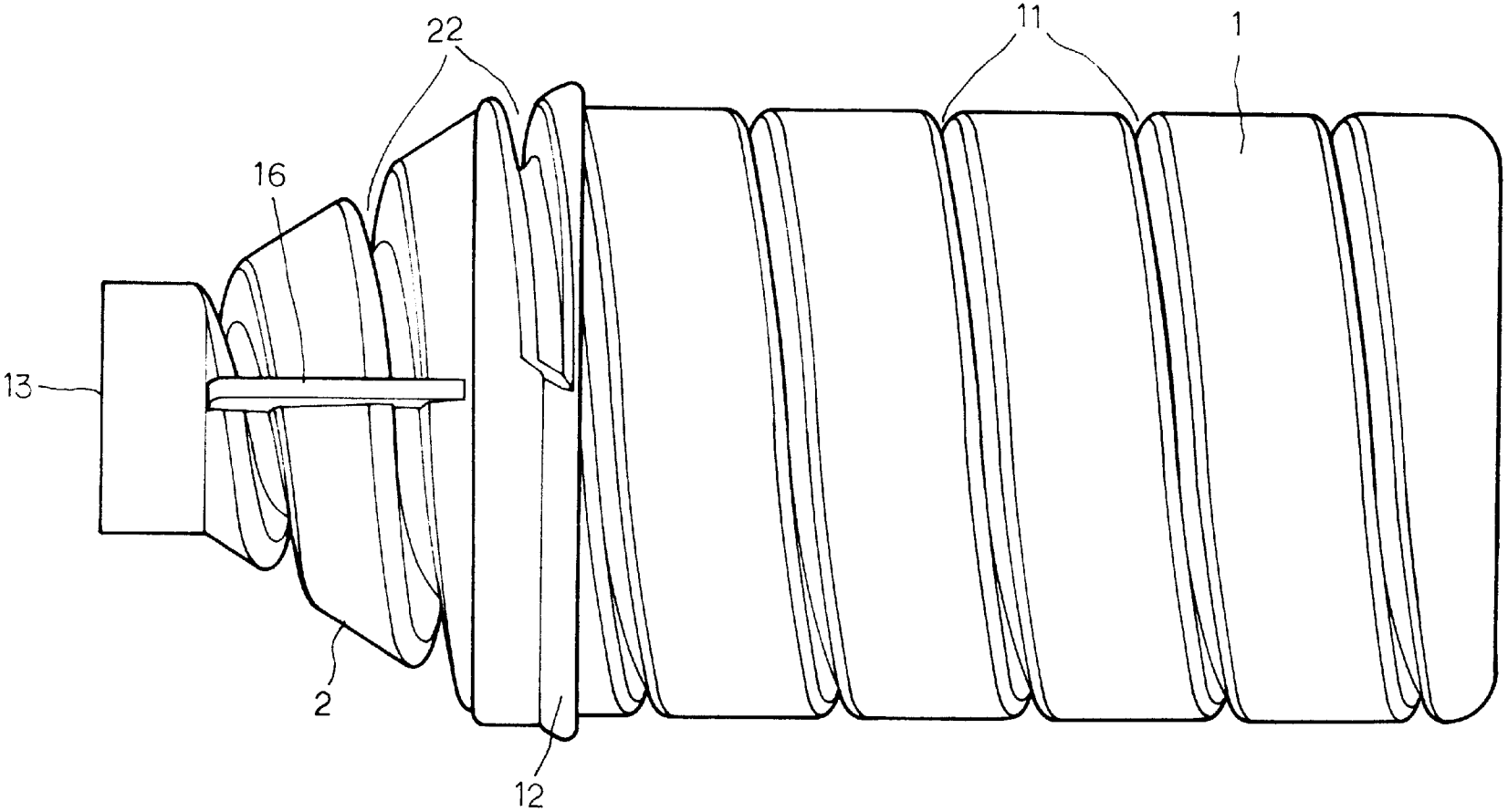
FIG. 2 is a side view of the developer replenishing container shown in FIG. 1.
Figure 3:
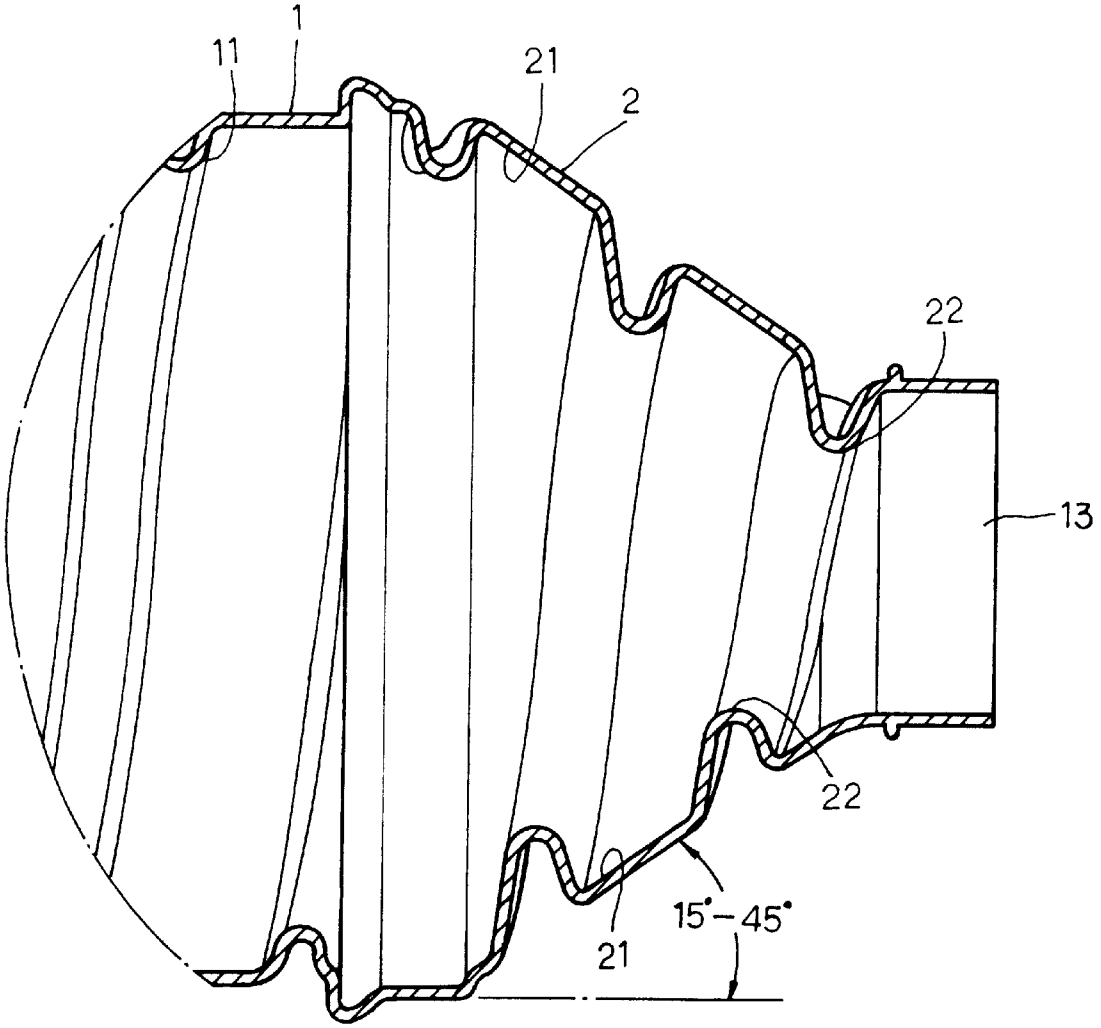
FIG. 3 is a side view in section in an enlarged scale of a part of the present invention, showing the structure of the conical developer guide.

Referring to FIGS. from 1 through 3, a developer replenishing container is shown comprising a cylindrical body portion 1 holding a developer (not shown), a bottle neck 13 at one end for output of the developer, a developer guide cone 2 connected between the cylindrical body portion 1 and the bottle neck 13, a spiral guide way 11 around the inside wall of the cylindrical body portion 1 to guide the developer out of the body portion, a shoulder 12 raised around the outside wall of the cylindrical body portion 1 adjacent to the developer guide cone 2, and a fixed locating member 16 formed integral with the developer guide cone 2 for coupling to the transmission mechanism in the electrophotographic image forming apparatus, enabling the developer replenishing container to be rotated by the transmission mechanism.

The developer guide cone 2 has a diameter made gradually reduced toward the bottleneck 13. The angle of slope of the developer guide cone 2 is preferably within about 15°~45°. The developer guide cone 2 comprises a spiral guide wall portion 22 for guiding the developer from the cylindrical body portion 1 toward the bottleneck 13. The spiral guide wall portion 22 has a depth within about 3~18 mm. The spiral guide wall portion 22 defines a spiral developer flow passageway 21. The spiral developer flow passageway 21 has a rear end smoothly extended to the bottleneck 13 in a flush manner for guiding the developer to the bottleneck 13 smoothly.

As indicated above, the angle of slope the developer guide cone 2 is defined within about 15°~45°. If the developer guide cone 2 is made having a relatively smaller angle of slope, the horizontal distance of the developer guide cone 2 must be relatively increased, and the developer holding space of the cylindrical body portion 1 must be relatively reduced. If the developer guide cone 2 is made having a relatively greater angle of slope, it will be difficult to form the spiral guide wall portion 22 on the developer guide cone 2. The best angle of slope is about 34°.

The depth of the spiral guide wall portion 22 is designed at about 3~18 mm. Shorter depth of the spiral guide wall portion 22 cannot guide the developer smoothly toward the bottleneck 13. If the depth of the spiral guide wall portion 22 is designed over 20 mm, it will be difficult to form the spiral guide wall portion 22 on the developer guide cone 2. The best depth of the spiral guide wall portion 22 is designed at 15mm.

Further, the fixed locating member 16 can be made having a toothed shape, block-like shape, plate-like shape, or any of a variety of shapes.

Figure 4:
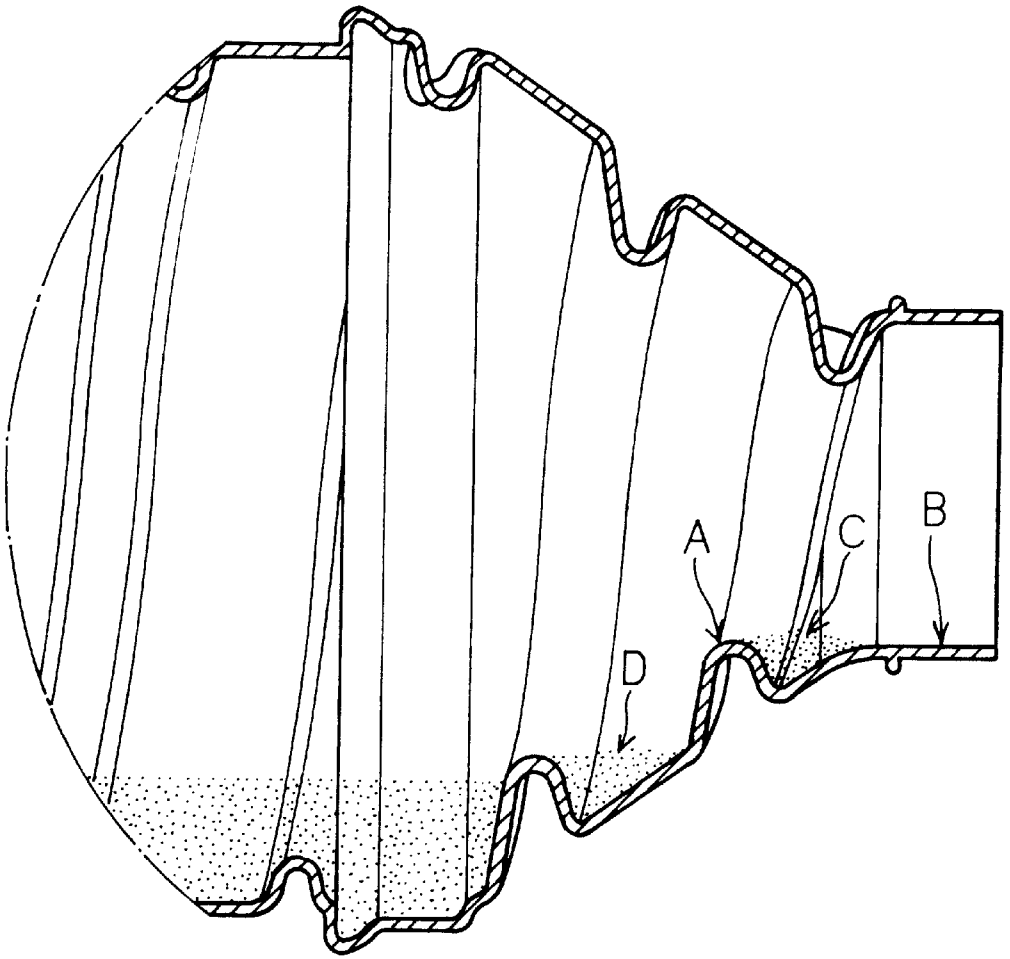
FIG. 4 is a schematic drawing explaining the delivery of developer through the developer guide cone to the bottleneck according to the present invention.

Referring FIG. 4 and FIGS. from 1 through 3 again, when the developer replenishing container is rotated in the electrophotographic image forming apparatus, the developer is propelled forwards along the spiral developer flow passageway 21 to the outside of the cylindrical body portion 1 via the bottle neck 13. When the spiral guide way 11 is moved with the cylindrical body portion 1 to the front side during rotary motion of the developer replenishing container, the volume at D of the developer guide cone 2 is moved with the spiral guide way 11 toward the bottle neck 13, causing the developer to be forced spirally forwards. When the narrowest part A of the inner diameter of the spiral guide wall portion 22 and the mouth B of the bottle neck 13 are disposed at the same elevation, the volume C in the spiral developer flow passageway 21 between A and B is the minimum, enabling developer to be continuously outputted to the bottle neck 13 at a fixed amount.

While only one embodiment of the present invention has been shown and described, it will be understood that various modifications and changes could be made thereunto without departing from the spirit and scope of the invention disclosed.

What the invention claimed is:

1. A developer replenishing container for use with an electrophotographic image forming apparatus comprising:

a cylindrical body portion having a spiral guide way on an inner side thereof to guide developer out of said body portion, and a bottle neck at an upper end of said cylindrical body portion for output of the developer, wherein a developer guide cone between said cylindrical body portion and said bottle neck defines a spiral guide wall portion and a spiral developer flow passageway for guiding developer from said cylindrical body portion toward said bottle neck, said developer guide cone having a diameter made gradually reduced toward said bottle neck, and an angle of slope within about 15°~45°, said spiral guide wall portion having a depth within about 3~18 mm, said spiral developer flow passageway having a rear end smoothly extended to said bottle neck in a flush manner for guiding developer to said bottle neck.

2. The developer replenishing container of claim 1 wherein the angle of slope of said developer guide cone is preferably about 34°.

3. The developer replenishing container of claim 1 wherein the depth of said spiral guide wall portion is preferably about 15 mm.

* * * * *